US006037061A

United States Patent [19]

Ohmi

[11] Patent Number: 6,037,061

[45] **Date of Patent: *Mar. 14, 2000**

[54] METHOD OF FORMING PASSIVE OXIDE FILM BASED ON CHROMIUM OXIDE, AND STAINLESS STEEL

[76] Inventor: Tadahiro Ohmi, 1-17-301, Komegabukuro 2-chome, Aoba-ku Sendai-shi, Miyagi-ken 980, Japan

[ * ] Notice: This patent is subject to a terminal disclaimer.

[21] Appl. No.: 08/988,150

[22] Filed: Dec. 10, 1997

Related U.S. Application Data

[62] Division of application No. 08/630,811, Apr. 10, 1996, Pat. No. 5,817,424, which is a division of application No. 08/244,123, May 19, 1994, Pat. No. 5,580,398.

[30] Foreign Application Priority Data

Nov. 20, 1991 [JP] Japan ..... 3-331349
May 29, 1992 [JP] Japan ..... 4-164377

[51] Int. Cl.[7] ..... B32B 9/00; C23C 8/10

[52] U.S. Cl. ..... 428/472.1; 428/472; 148/280; 148/286

[58] Field of Search ..... 428/472.1, 472; 148/276, 240, 280, 284, 286; 427/299, 309, 372.2

[56] References Cited

U.S. PATENT DOCUMENTS

| | | | |
|---|---|---|---|
| 4,266,987 | 5/1981 | Wang | 148/6.3 |
| 4,548,872 | 10/1985 | Lavezzari | 428/633 |
| 4,610,798 | 9/1986 | Burkus | 252/79.2 |
| 5,188,714 | 2/1993 | Davidson | 204/129.35 |
| 5,226,968 | 7/1993 | Ohmi | 118/720 |
| 5,259,935 | 11/1993 | Davidson | 204/129.1 |
| 5,580,398 | 12/1996 | Ohmi | 148/280 |
| 5,817,424 | 10/1998 | Ohmi | 428/472.1 |

FOREIGN PATENT DOCUMENTS

| | | |
|---|---|---|
| 54-13992 | 2/1979 | Japan . |
| 1-198463 | 8/1989 | Japan . |
| 2-43353 | 2/1990 | Japan . |
| 3-153858 | 7/1991 | Japan . |
| 3-219052 | 9/1991 | Japan . |
| 2092621 | 8/1982 | United Kingdom . |

*Primary Examiner*—Timothy Speer
*Assistant Examiner*—Stephen Stein
*Attorney, Agent, or Firm*—Baker & Daniels

[57] ABSTRACT

A method of readily forming passive oxide film based on chromium oxide characterized by subjecting stainless steel to electrolytic polishing and fluidized abrasive polishing, baking the steel thus treated in an inactive gas to remove moisture from its surface, and heat treating the resultant steel at 300 to 600° C. in a gaseous atmosphere comprising hydrogen or a mixture with an inactive gas and containing less than 4 ppm of oxygen or less than 500 ppb of moisture. An oxidized stainless steel characterized by comprising a stainless steel having a crystal grain number of 6 or above and, formed on the surface thereof, a passive oxide film based on chromium oxide, wherein the oxide film has a thickness of 5 nm or above and the atomic ratio of chromium to iron in the outermost layer of the film is 1 or above.

10 Claims, 15 Drawing Sheets

METHOD OF FORMING PASSIVE OXIDE FILM BASED ON CHROMIUM OXIDE, AND STAINLESS STEEL

This is a division of application Ser. No. 08/630,811, now U.S. Pat. No. 5,817,424 filed Apr. 10, 1996, which is a division of application Ser. No. 08/244,123, now U.S. Pat. No. 5,580,398 filed May 19, 1994.

TECHNICAL FIELD

The present invention relates to a method for forming a passive oxide film having chromium oxide as a chief component thereof, as well as to a stainless steel.

BACKGROUND OF THE INVENTION

Conventionally, two methods were known for the formation of a passive oxide film having chromium oxide as a chief component thereof on a stainless steel surface: the dry method, in which, after directly reacting stainless steel with oxygen gas, the oxidized steel was reduced with hydrogen gas and heat treated with an inert gas such as argon after reduction, and thereby, a passive film having chromium oxide as a chief component thereof was formed; and the wet method, in which the steel was etched using a chemical such as nitric acid or the like, and chromium oxide was obtained. A diagram of the processes of the dry method is shown in FIG. 5(*b*).

In FIG. 5(*b*), (1) indicates a baking process which removes moisture adhering to the stainless steel surface, and moisture released by the stainless steel surface. (2) indicates an oxidation process which is conducted in an oxygen atmosphere. The film obtained by this oxidation process is a passive oxide film having iron oxide as a chief component thereof. (3) indicates a reducing process in which the iron oxide is reduced in a hydrogen atmosphere in order to obtain chromium oxide. (4) indicates a heat treatment process in an inert gas atmosphere for the purpose of conversion to a film having chromium oxide as the chief component thereof. In this way, in accordance with the dry method, the formation of the chromium oxide is conducted by means of independent oxidation and reduction reactions, so that the period required for the processes is long.

FIG. 6 shows data relating to moisture released at normal temperatures from passive oxide films obtained by means of the wet method and the dry method, as measured by APIMS. As is clear from FIG. 6, in contrast to the passive oxide film formed in accordance with the dry method, which ceased giving off moisture after several minutes, the passive oxide film obtained in accordance with the wet method continued to give off moisture even after the passage of 100 minutes. In this way, the passive oxide film obtained in accordance with the wet method contained a large moisture component, so that if the moisture were not removed, such a passive oxide film could not be used in semiconductor production apparatuses, which must be free of outside gasses, and heat treatment such as baking or the like was necessary, so that in the same manner as with the dry method, considerable time was required.

The present invention has as an object thereof to provide a method of forming a passive oxide film having chromium oxide as a chief component thereof which is capable of easily forming a passive oxide film having chromium oxide as a chief component thereof, and to provide a stainless steel having a passive oxide film having chromium-oxide as a chief component thereof.

SUMMARY OF THE INVENTION

A first essential feature of the present invention resides in a stainless steel having a crystal grain number of 6 or above and having formed on the surface thereof a passive oxide film having a thickness of 5 nm or above and in which the value of Cr/Fe (hereinbelow, this refers to an atomic ratio) at the outermost layer of the film is 1 or above.

A second essential feature of the present invention resides in a stainless steel having an amount of warp of 0.2% or more having formed on the surface thereof a passive oxide film having a thickness of 5 nm or above, and wherein the value of Cr/Fe at the outermost layer of the film is 1 or above.

A third essential feature of the present invention resides in a method of forming a passive oxide film having chromium oxide as a chief component thereof, characterized in that stainless steel is subjected to electrolytic polishing, then baking is conducted in an inert gas, and thereby, moisture is removed from the surface of the stainless steel, and then heat treatment is conducted at a temperature within a range of 300° C. to 600° C. in a gaseous atmosphere comprising hydrogen or a mixture thereof with an inert gas and containing less than 4 ppm of oxygen or less than 500 ppb of moisture.

A fourth essential feature of the present invention resides in a method of forming a passive oxide film having chromium oxide as a chief component thereof, characterized in that stainless steel is subjected to composite electrolytic polishing, then baking is conducted in an inert gas, and thereby, moisture is removed from the surface of the stainless steel, and then heat treatment is conducted at a temperature within a range of 300° C. to 600° C. in a gaseous atmosphere comprising hydrogen or a mixture thereof with an inert gas and containing less than 4 ppm of oxygen or less than 500 ppb of moisture.

A fifth essential feature of the present invention resides in a method of forming a passive oxide film having chromium oxide as a chief component thereof, characterized in that a stainless steel is subjected to fluidized abrasive polishing, then baking is conducted in an inert gas to remove moisture from the surface of the stainless steel, and then heat treatment is conducted at a temperature within a range of 300° C. to 600° C. in a gaseous atmosphere comprising hydrogen gas or a mixture thereof with an inert gas and containing less than 4 ppm of oxygen or less than 500 ppb of moisture.

Hereinbelow, the function of the present invention will be explained together with embodiment examples.

It is preferable that SUS316I having a composition such that, for example, $C \leqq 0.020\%$ (hereinbelow, this percentage refers to weight percent), $Si \leqq 0.50\%$, $Mn \leqq 0.80\%$, $P \leqq 0.030\%$, $S \leqq 0.0020\%$, Ni is within a range of 12.0%–17.0%, Cr is within a range of 17.0%–24.0%, Mo is within a range of 0.05–3.5%, and $Al \leqq 0.020\%$, be used as the stainless steel which is the object of the present invention. It is preferable that the amount of oxygen contained be 20 ppm or below, and an amount less than several ppm is further preferable. If the amount of oxygen contained exceeds a level of 20 ppm, a porous passive film will be formed, and a porous passive film exhibits low resistance to corrosion even if the Cr/Fe ratio is high.

In the method of the present invention, first, the stainless steel is first subjected to electrolytic polishing. The surface roughness after electrolytic polishing should, from the point of view of the formation of a minute passive film, be 5 $\mu$m or less and a roughness of 1 $\mu$m or less is further preferable, while a roughness of 0.5 $\mu$m or less is still further preferable.

After electrolytic polishing, baking is conducted in an inert gas, and thereby, moisture present on the surface of the stainless steel is removed. The baking temperature and period are not particularly limited, if as the temperature is sufficient to remove adhering moisture; however, a temperature within a range of, for example, 150° C.–200° C. is acceptable. The baking should preferably be conducted in an inert gas (for example, Ar, or $N_2$) atmosphere having a moisture content of less than several ppm.

Next, heat treating is conducted at a temperature within a range of 300° C.–600° C. in a gaseous atmosphere comprising hydrogen or a mixture thereof with an inert gas and containing less than 4 ppm of oxygen or less than 400 ppb of moisture. At temperatures of less than 300° C., the formation of a passive film having chromium oxide as a chief component thereof is insufficient. When the temperature exceeds 600° C., the minuteness of the passive film which is formed is poor. A temperature range of 400° C.–600° C. is further preferable for this heat treatment. The period of heat treatment should preferably be within a range of from 10 minutes to less than 10 hours, and a period within a range of 30 minutes to less than several hours is further preferable.

In the present invention, it is preferable that a stainless steel having a crystal grain size of 6 or more be used, and it is further preferable that a stainless steel having a crystal grain size of 8 or above be used. When a stainless steel having such a grain size is used, the atomic range of Cr/Fe at the surface of the passive film which is formed increases greatly. The reason for this is somewhat unclear; however, it is thought that when stainless steel having this crystal grain size is used, the chromium atoms are dispersed throughout the surface via the crystal grain boundaries, so that the value of Cr/Fe increases greatly.

When a stainless steel having a grain number of 6 or more is used during formation of the passive oxide film by means of high temperature baking at a temperature within a range of 400° C.–600° C. in an inert gas atmosphere after electrolytic polishing, the thickness of the passive film increases, and furthermore, it is possible to form a passive film having chromium oxide as the chief component thereof.

Furthermore, in place of regulating the crystal grain size of the stainless steel, it is possible to conduct cold working having a surface reduction ratio of 2% or more prior to electrolytic polishing.

When stainless steel having an oxygen content of several ppm or below is employed, it is possible to form a passive film which is more minute than that formed in the case of stainless steel having an oxygen content of several ppm or more.

If composite electrolytic polishing or fluidized abrasive polishing is conducted in place of electrolytic polishing, it is possible to form a passive film which is minute and has a high Cr content. That is to say, the passive oxide film which is formed on the surface of the stainless steel contains a higher concentration of chromium oxide and is a more minute film than that formed in the case in which electrolytic polishing is conducted. The reason for this is thought to be that microfissures are generated on the surface as a result of composite electrolytic polishing or fluidized abrasive polishing, and chromium is deposited in the surface through these fissures. Such fissures are either covered by the passive film during passive film formation, or are eliminated thereby, and thus do not affect the surface characteristics.

It is still further preferable that after composite electrolytic polishing or fluidized abrasive polishing, a slight electrolytic polishing be conducted in order to remove the layer altered by working, and that the surface layer be etched to a depth of several molecules.

Furthermore, in the present invention, if the stainless steel is heated in a gaseous atmosphere comprising hydrogen or a mixture of hydrogen gas and an inert gas (for example, argon gas or nitrogen gas) after conducting electrolytic polishing, composite electrolytic polishing, or fluidized abrasive polishing, oxygen from a porous layer containing oxygen which remains on the surface of the stainless steel after electrolytic polishing serves as a source of oxygen for formation of the passive film, and as described above, the oxidation and reduction reactions occur simultaneously, and a passive oxide film having chromium oxide as a chief component thereof can be easily formed by reducing the iron oxide. The amount of oxygen contained in the stainless steel may preferably be within a range of from several ppm to 1 weight percent or below. In this case, as well, it is preferable that composite electrolytic polishing or fluidized abrasive polishing be conducted, and it is further preferable that after this, slight electrolytic polishing be conducted and the surface be etched to a depth of several molecules.

Hereinbelow, the present invention will be explained in detail.

In the present invention, as shown in FIG. 5(*a*), simply by conducting the baking process and the oxidation and reduction process, it is possible to form a passive oxide film having chromium oxide as a chief component thereof.

In the formation method for the passive oxide film having chromium oxide as the chief component thereof in accordance with the present invention, first, the surface of the stainless steel is subjected to electrolytic polishing. It is preferable that the surface roughness thereof be Rmax 5 $\mu$m or less. Next, baking is conducted, and thereby the adhering moisture is removed.

Next, the stainless steel is subjected to heat treatment in the presence of hydrogen containing a trace amount of oxygen or a trace amount of moisture. Simply by conducting such heat treatment, a passive oxide film having chromium oxide as a chief component thereof is formed. In this case, less than 4 ppm of oxygen or less than 500 ppb of moisture should be present.

In contrast, in the case in which stainless steel is employed which contains oxygen, there is no need to externally supply oxygen or moisture.

The hydrogen may be diluted with an inert gas, and it is preferable that the hydrogen concentration be within a range of from less than several ppm–10%.

DESCRIPTION OF THE PREFERRED EMBODIMENT

Hereinbelow, the present invention will be explained in further detail based on Embodiments.

(Embodiment 1)

In the present Embodiment, SUS316L stainless steel having a grain number of 5 and containing 25 ppm of oxygen was subjected to electrolytic polishing, and a surface roughness of approximately 5 $\mu$m was obtained.

Next, the stainless steel was placed in a furnace, and baking was conducted at 150° C. for a period of 2 hours while supplying an Ar gas having an impurity concentration of less than several ppb into the furnace, and moisture adhering to the surface was removed.

After the completion of the above baking, hydrogen gas was mixed with argon gas so that a hydrogen concentration of 10% was reached, and heat treatment was carried out at a temperature of 500° C. and for a period of 2 hours.

Figure 1:
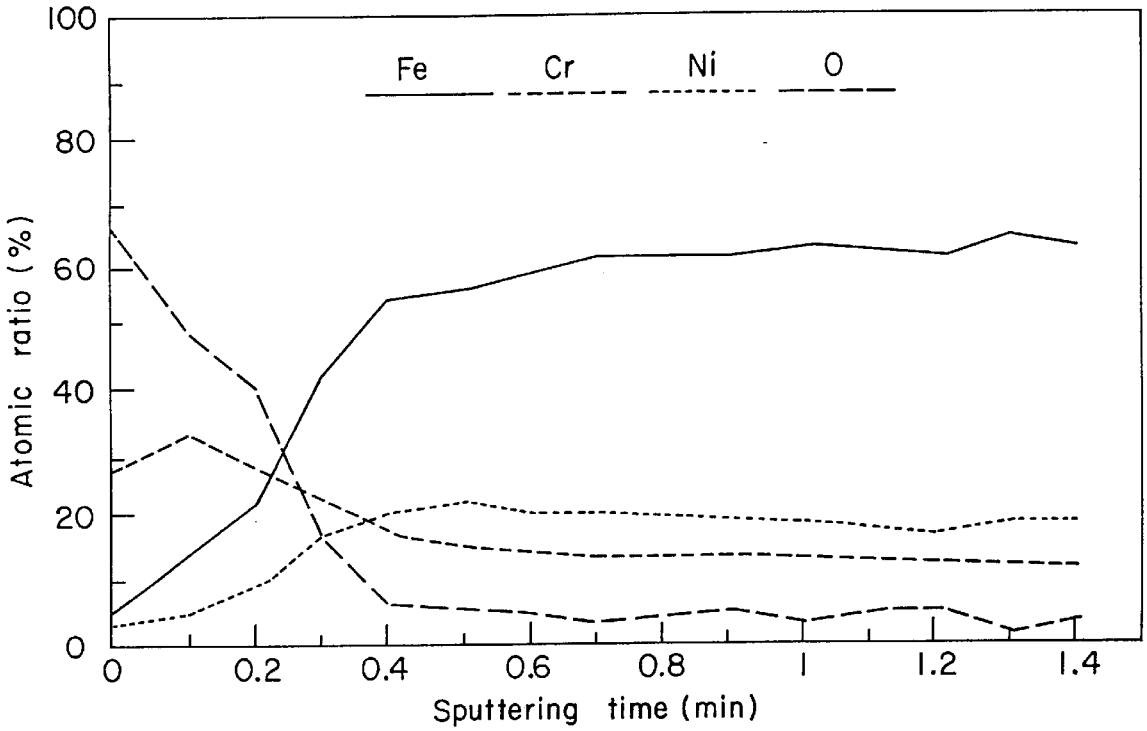
FIG. 1 shows an XPS analysis of the passive oxide film formed in Embodiment 1.

The results of an XPS analysis of the passive film formed under the above conditions are shown in FIG. 1. The sputtering rate was 10 nm/min. As is clear from FIG. 1, the concentration of the chromium component was high to a considerable depth in the passive film formed under the above conditions, and it is clear that a passive film having chromium oxide as a chief component thereof was formed. That is to say, the value of Cr/Fe is 5 or greater, and the thickness of the passive film was 2.5 nm or greater.

(Embodiment 2)

In the present Embodiment, stainless steel (SUS316L) in which the oxygen content was maintained at a level of less than several ppm was employed.

The other conditions were identical to those of Embodiment 1, and electrolytic polishing and baking were conducted.

However, heat treatment was conducted at a temperature of 500° C. and for a period of 1 hour in a gas in which hydrogen and oxygen were added to an argon gas base so that the hydrogen concentration was 10%, and oxygen was present at a level of 100 ppb.

Figure 2:
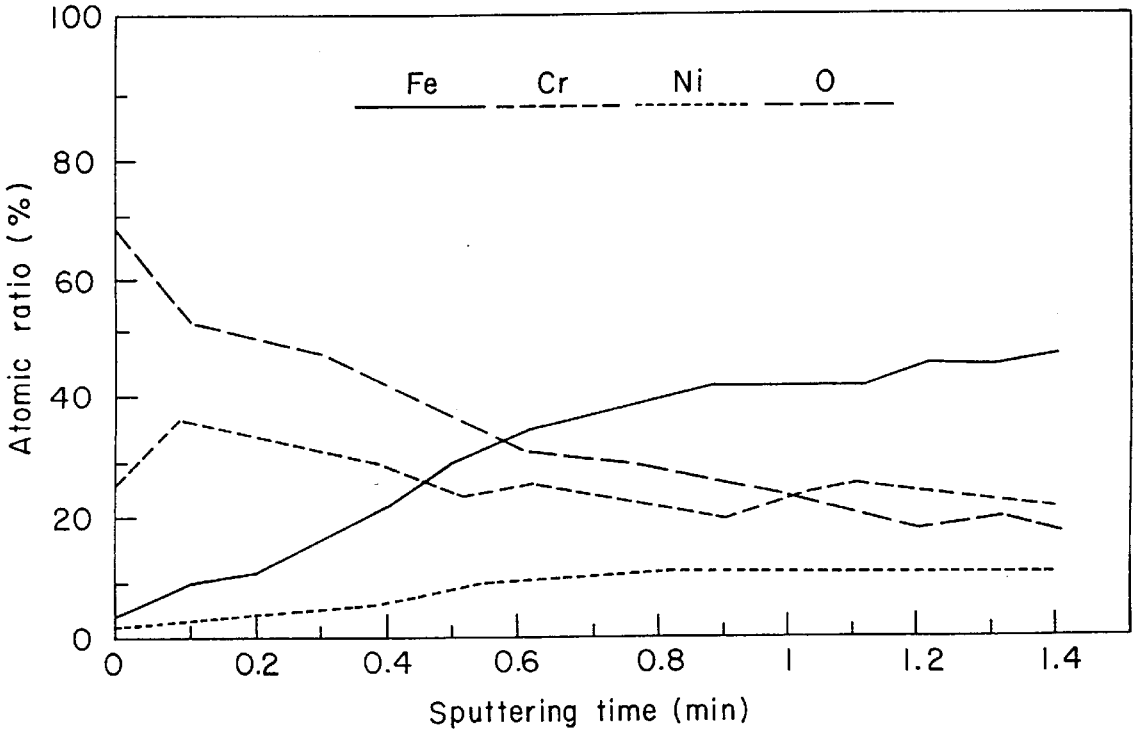
FIG. 2 shows an XPS analysis of the passive oxide film formed in Embodiment 2.

The results of an XPS analysis of the passive film formed under the above conditions are shown in FIG. 2. As is clear from FIG. 2, the passive film formed under the above conditions was a passive film having chromium oxide as a chief component thereof. That is to say, the value of Cr/Fe was 6 or greater, and the thickness of the passive film was 5 nm or greater.

Comparative Example 1

In the present Comparative Example, as in Embodiment 2, stainless steel having an oxygen content of several ppm or below was employed. Furthermore, electrolytic polishing and baking were conducted in a manner identical to that of Embodiment 2.

Next, heat treatment was conducted at a temperature of 500° C. and for a period of 1 hour in a mixed gas in which hydrogen and oxygen were added to an argon gas base so that the concentration of hydrogen was 10% and the concentration of oxygen was 10%.

Figure 3:
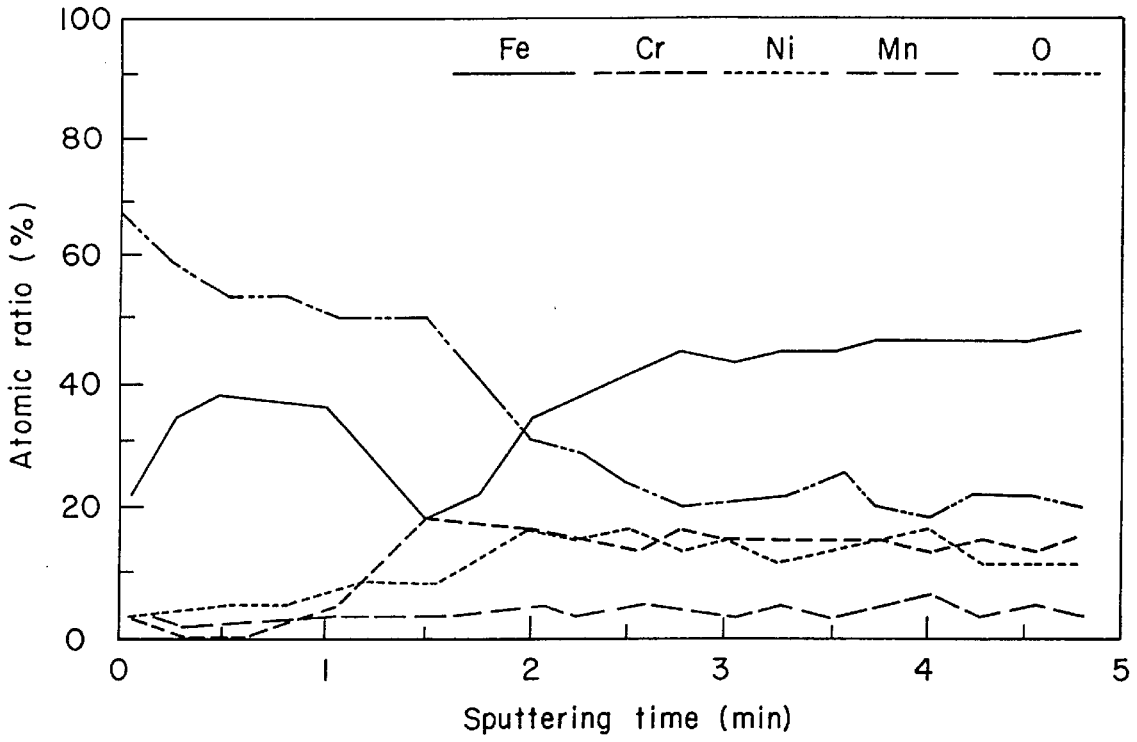
FIG. 3 shows an XPS analysis of the passive oxide film formed in a Comparative Example.

The results of an XPS analysis of the passive film formed under the above conditions are shown in FIG. 3. As is clear from FIG. 3, the passive film has iron oxide as a chief component. It can be seen that if the amount of oxygen added exceeds the appropriate amount, the iron is not reduced but is oxidized.

(Embodiment 3)

In the present Embodiment, heat treatment was conducted at a temperature of 500° C. and for a period of 1 hour in a gas in which hydrogen, oxygen, and moisture were added to an argon gas base so that the concentration of hydrogen was 10%, oxygen was present at a level of 100 ppb, and moisture was present at a level of 100 ppb. The other conditions were identical to those in Embodiment 2.

Figure 4:
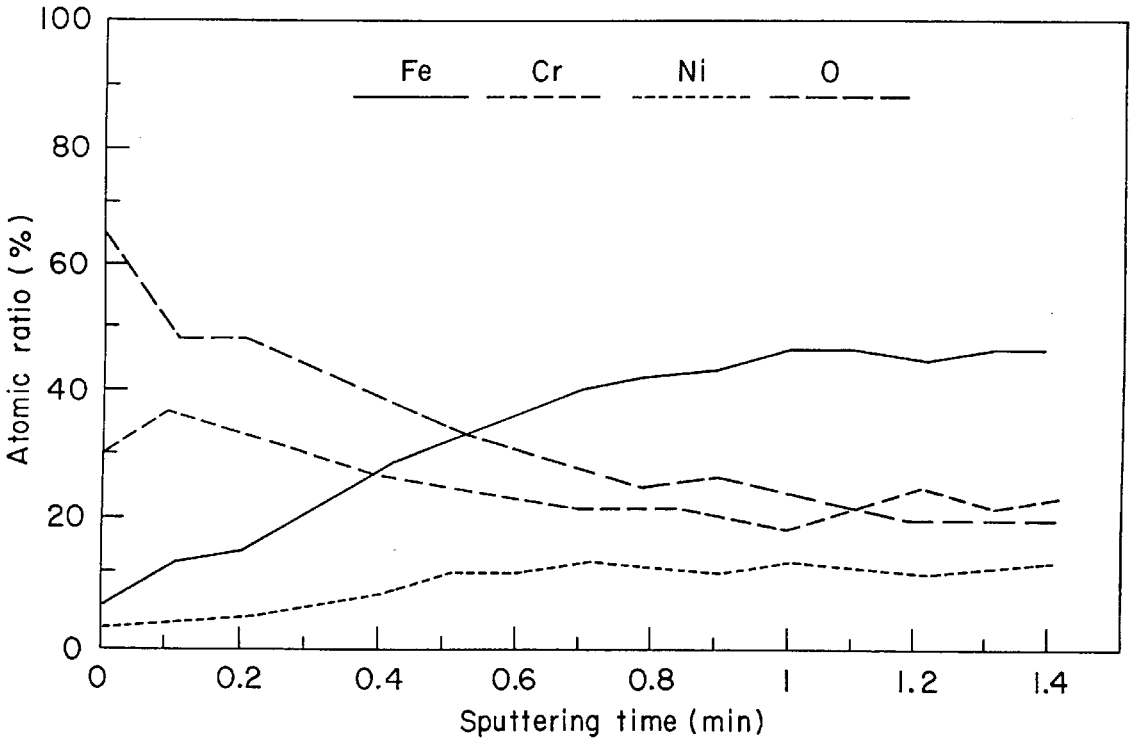
FIG. 4 shows an XPS analysis of the passive oxide film formed in Embodiment 3.
Figure 5A:
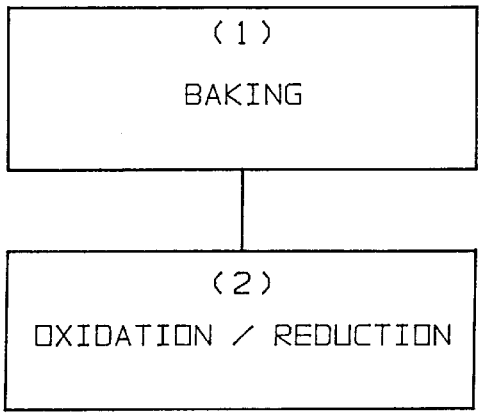
FIG. 5(*a*) is a process diagram showing the processes for formation of a passive film in accordance with the method of the present invention, and FIG. 5(*b*) is a process diagram showing the conventional processes for passive film formation.
Figure 5B:
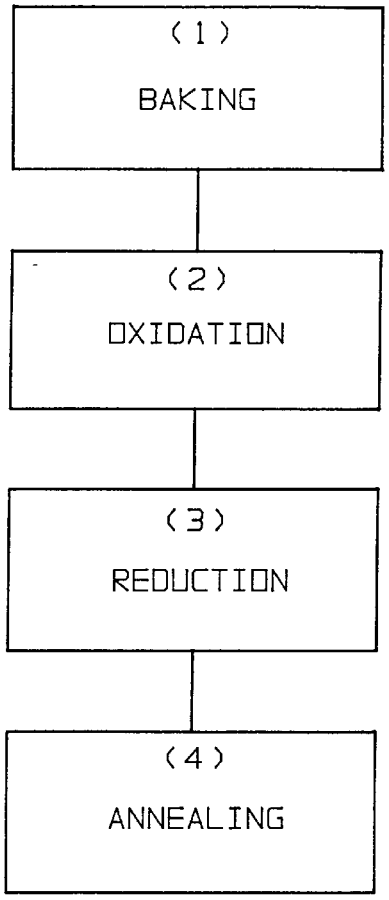
Figure 6:
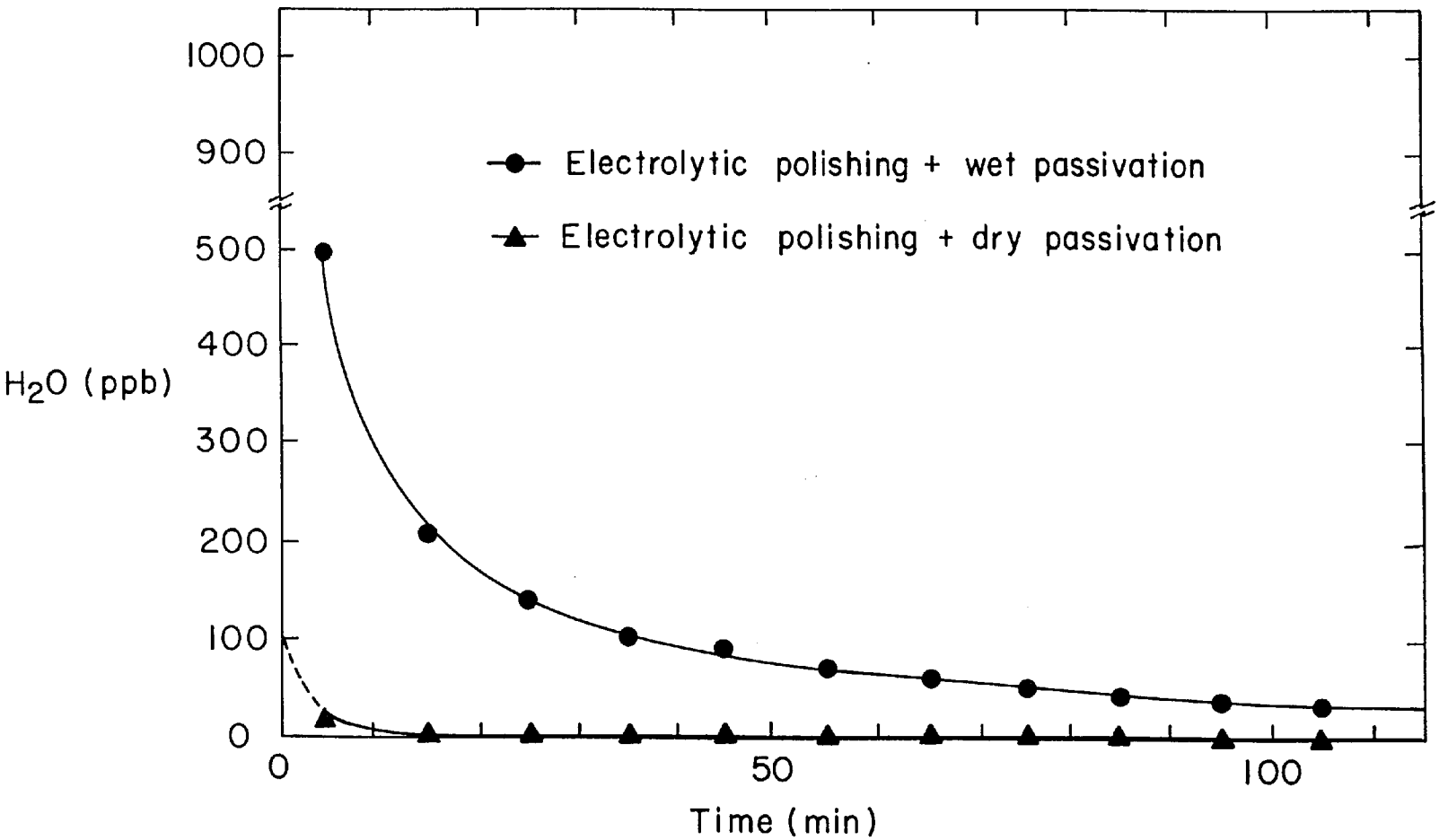
FIG. 6 is a graph showing data relating to moisture released from passive oxide films at normal temperatures as measured by APIMS.

The results of an XPS analysis of the passive film formed under the above conditions are shown in FIG. 4. As is clear from FIG. 4, the passive film formed under the above conditions has chromium oxide as a chief component thereof. That is to say, the value of Cr/Fe is 5 or greater, and the thickness of the passive film was 5 nm or more.

(Embodiment 4)

Using SUS316L stainless steel, electrolytic polishing was conducted in a manner identical to that of Embodiment 1. This was designated sample 1.

Next, baking was conducted in a manner identical to that of Embodiment 1, heat treatment was conducted at a temperature of 500° C. and for a period of 1 hour in an atmosphere of a gas in which hydrogen and oxygen were added to an argon gas base so that the hydrogen concentration was 10%, and oxygen was present at a level of 100 ppb, and a passive oxide film was thus formed. This was designated sample 2.

SUS316L stainless steel was subjected to composite electrolytic polishing, electrolytic polishing was conducted so as to remove the layer altered by working on the surface, and baking and heat treatment were conducted in a manner identical to that of sample 2, and a passive oxide film was formed. This was designated sample 3.

Figure 7A:
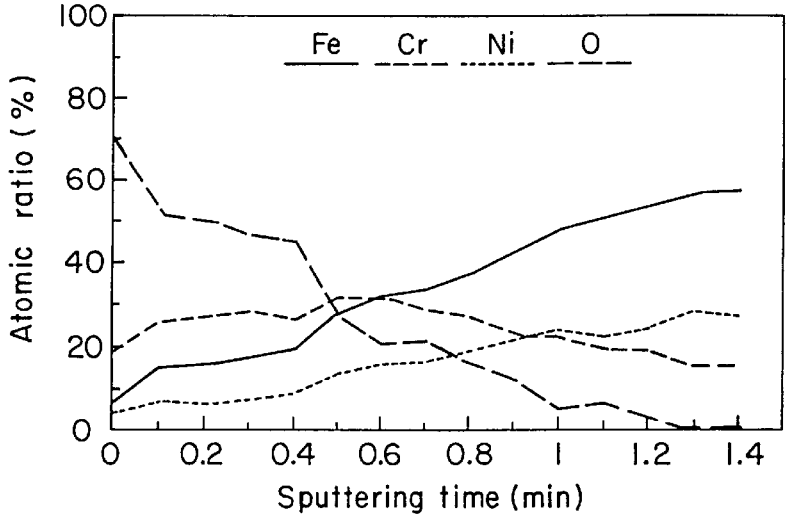
FIG. 7 shows an XPS analysis of the passive oxide film formed in Embodiment 4.
Figure 7B:
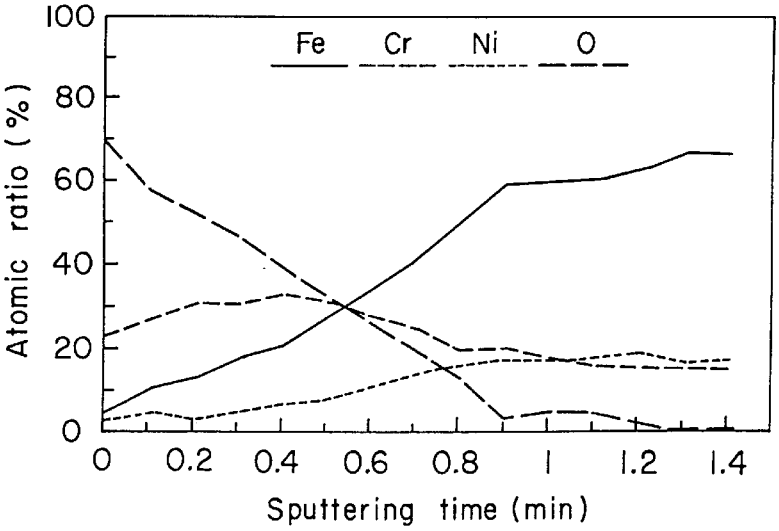
Figure 7C:
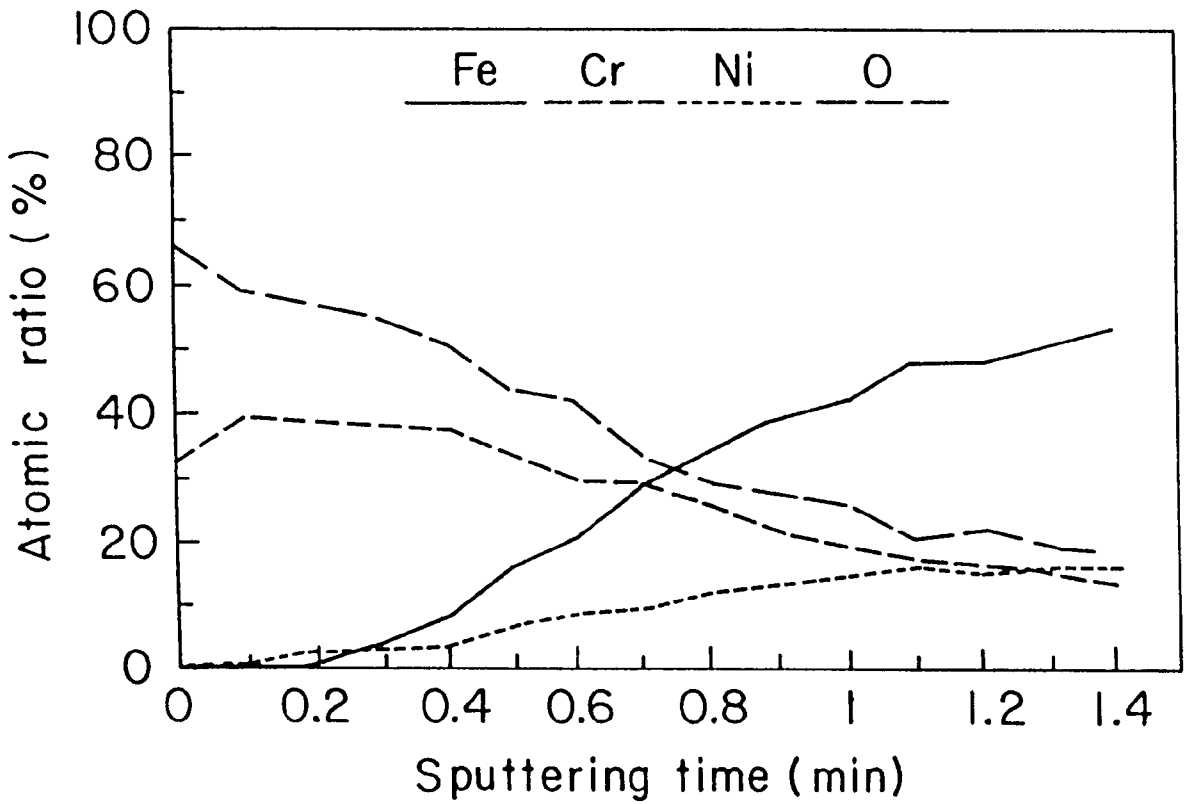

The results of an XPS analysis of the surface layers of samples 1, 2, and 3 are shown in FIG. 7(*a*), (*b*), and (*c*), respectively. As shown in FIG. 7, oxide films having a high concentration of chromium at the surface were formed on each of samples 1, 2, and 3. However, by comparing the peak positions of chromium oxide in the XPS spectra, it was determined that in contrast with the chromium oxide of samples 2 and 3, which was a stoichiometric compound, the peak of the chromium oxide of sample 1 represented a shift from the chromium oxide peak in a stoichiometric ratio, and it is thus clear that the oxide film present after electrolytic polishing is not a minute oxide film. Furthermore, the passive oxide film of sample 3 was not merely thick, but the chromium oxide concentration thereof was extremely high, and moreover, no iron was present within 2 nm of the surface, so that this suggests that an extremely minute passive film was formed.

Next, samples 1 through 3 were placed in an extremely harsh environment of HCl gas at a temperature of 100° C. for a period of 20 minutes, and the state of the surface was then observed by means of a scanning electron microscope (SEM), and an XPS analysis of the surface layer was conducted. The results of the XPS analysis are shown in FIG. 8, while the scanning electron micrographs are shown in FIG. 9.

Figure 8A:
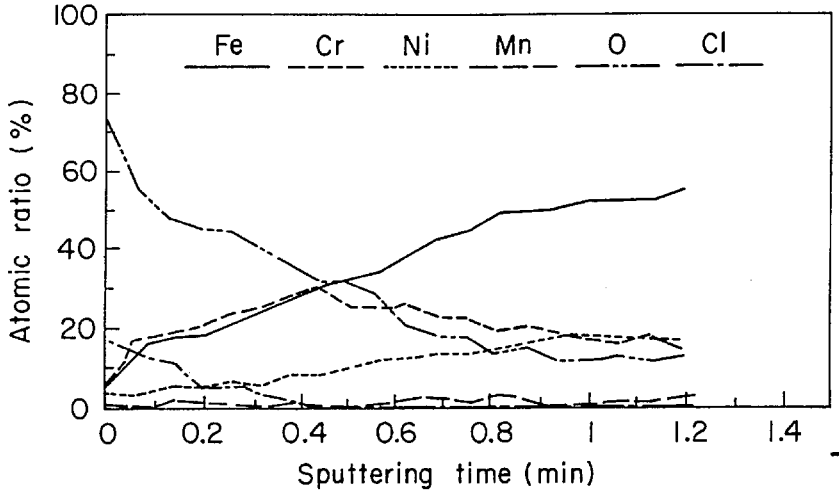
FIG. 8 shows an XPS analysis of the passive oxide film formed in Embodiment 4 after a corrosion resistance test.
Figure 8B:
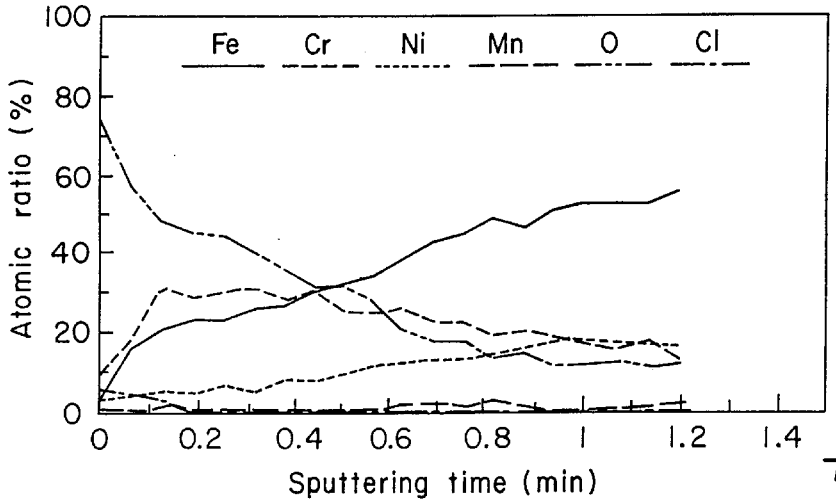
Figure 8C:
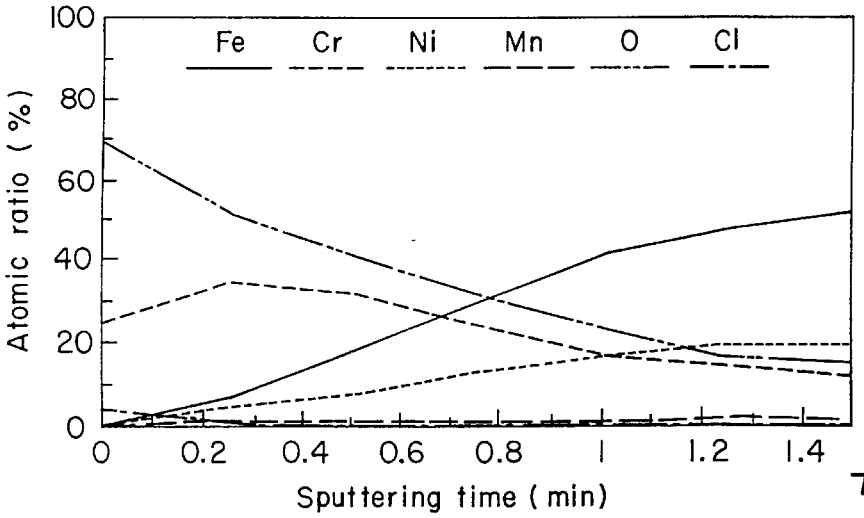
Figure 9A:
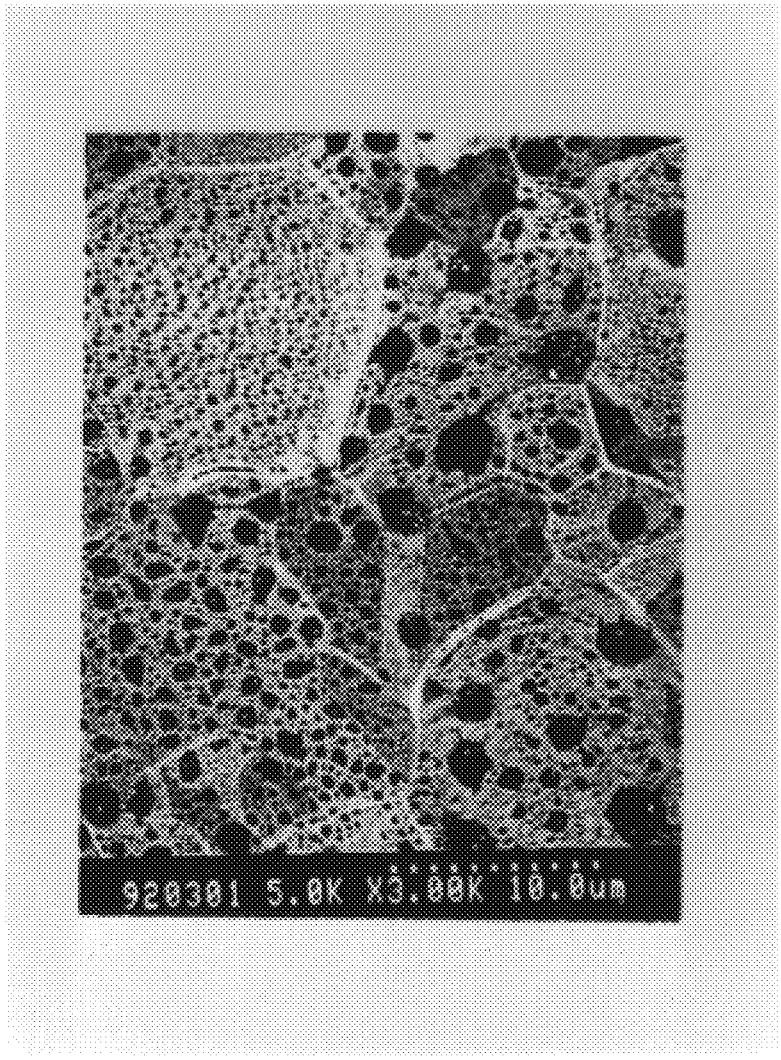
FIG. 9 is a scanning electron micrograph of the passive oxide film formed in Embodiment 4 after the corrosion resistance test.
Figure 9B:
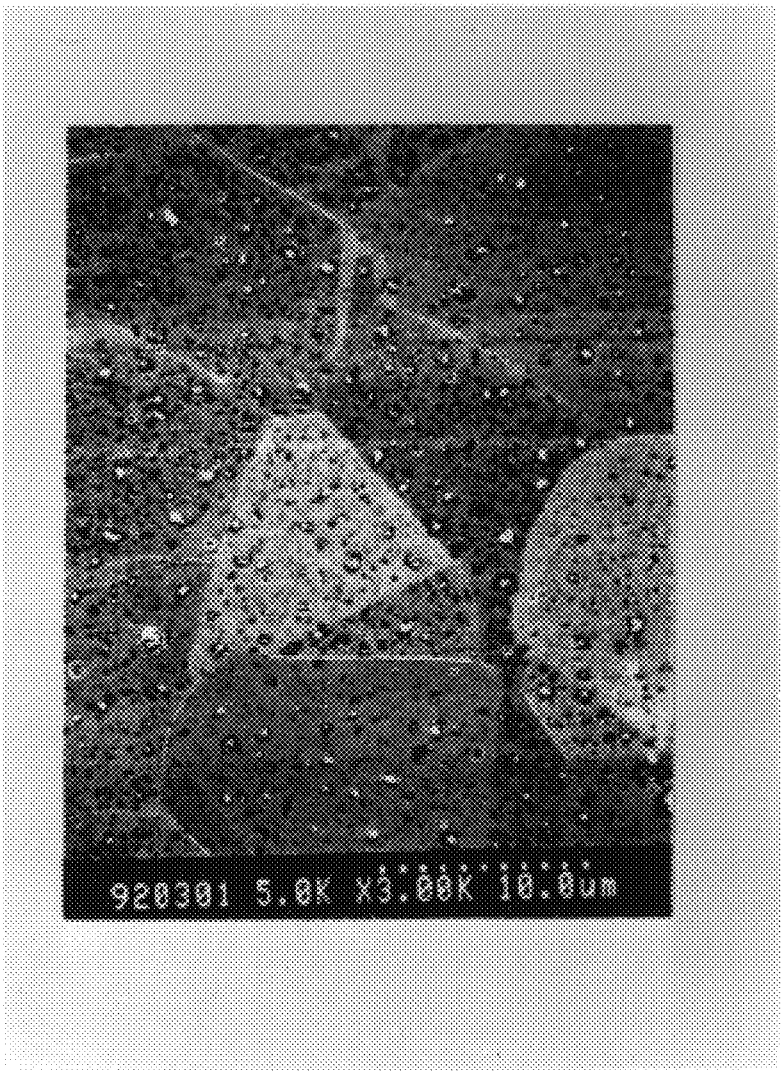
Figure 9C:
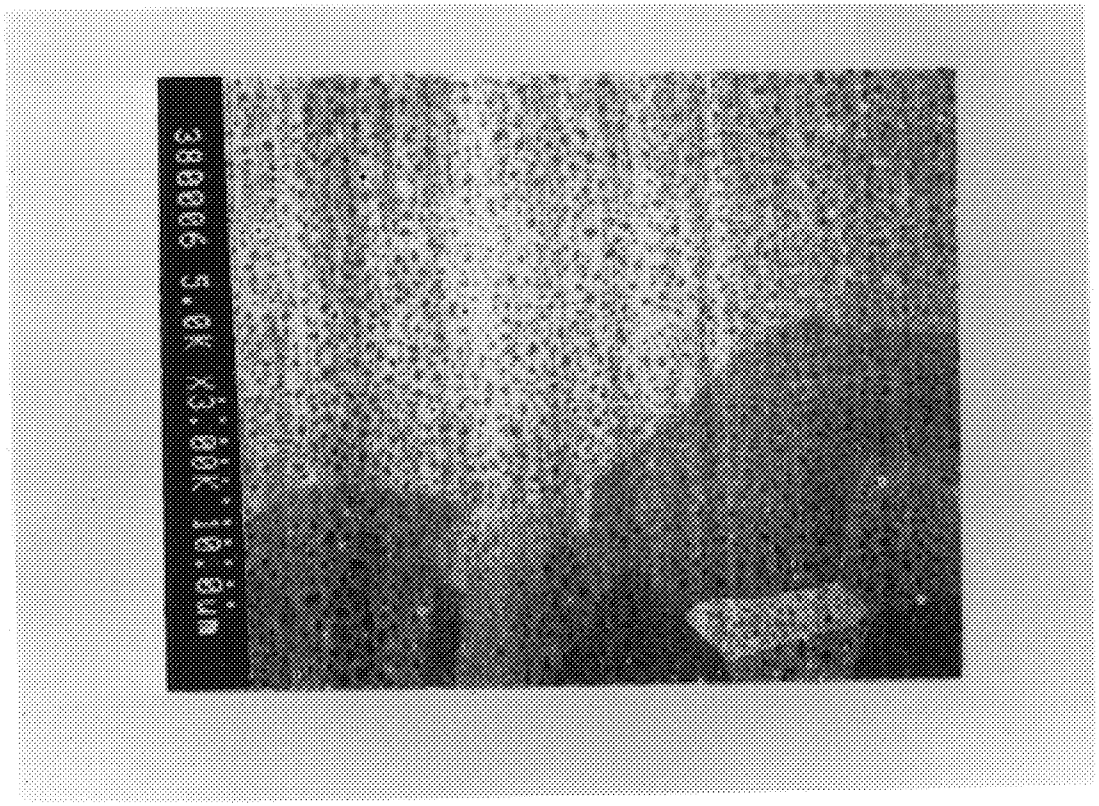

As is clear from FIGS. 8 and 9, in sample 1, the chromium concentration was greatly reduced, and the surface was rough. This is thought to be because the chromium oxide was not stoichiometric chromium oxide, which has a high resistance to corrosion. Furthermore, in sample 2, the thickness of the film having chromium oxide as a chief component thereof was reduced even though the chromium oxide was in a stoichiometric ratio, and the chromium concentration at the surface was reduced. Furthermore, slight roughness was observed in the surface. The reason for this is thought to be that since iron oxide was contained in large amounts, the iron oxide separated as a result of corrosion, and the chromium oxide separated along with this. However, a passive film having chromium oxide as a chief component thereof remained on the surface of sample 2, and in consideration of the testing conditions, the passive film would sufficiently stand up to use under normal conditions.

In contrast to samples 1 and 2, in sample 3, almost no change was observed in the surface state and in the film composition before and after corrosion testing, and thus extremely superior resistance to corrosion was exhibited. As can be seen from FIG. 7(*c*), the value of Cr/Fe in sample 3 was 30 or more, and furthermore, the thickness of the sample film was 8 nm or more.

From the above results, it can be seen that a more superior passive film can be obtained when composite electrolytic polishing is conducted than when electrolytic polishing is conducted.

(Embodiment 5)

SUS316L stainless steel was subjected to fluidized abrasive polishing using alumina having a grain size of 20 $\mu$m, and then the layer altered by working was removed from the surface by means of electrolytic polishing. Next, baking was conducted in a manner identical to that of Embodiment 1, and heat treatment was conducted at a temperature of 500° C. and for a period of 1 hour in an atmosphere of a gas in which hydrogen and oxygen were added to an argon gas base so that the hydrogen concentration was 10% and oxygen was present at a level of 100 ppb, and a passive oxide film was thus formed.

The passive oxide film which was obtained exhibited extremely superior resistance to corrosion, as was the case with sample 3 of Embodiment 4.

(Embodiment 6)

SUS316L stainless steel was subjected to composite electrolytic polishing, and baking was conducted in a manner identical to that of Embodiment 1, heat treatment was conducted at a temperature of 500° C. and for a period of 1 hour in an atmosphere of a gas in which hydrogen and oxygen were added to a base argon gas so that the hydrogen concentration was 10% and oxygen was present at a level of 100 ppb, and a passive oxide film was formed.

The passive oxide film which was obtained had a chromium oxide layer at a depth of 1–2 nm at the surface which was identical to that of sample 3 of Embodiment 4. Furthermore, when the corrosion resistance test discussed in Embodiment 3 was conducted, slight surface roughness was observed. However, as described above, in consideration of the conditions of the corrosion resistance test, the passive oxide film of Embodiment 6 would be sufficiently able to stand up to use under normal conditions.

(Embodiment 7)

SUS316L stainless steel was subjected to fluidized abrasive polishing using alumina having a grain size of 20 $\mu$m, and then baking was conducted in a manner identical to that of Embodiment 1, heat treatment was conducted at a temperature of 500° C. and for a period of 1 hour in an atmosphere of a gas in which hydrogen and oxygen were added to a base argon gas so that the hydrogen concentration reached 10% and oxygen was present at a level of 100 ppb, and a passive oxide film was formed.

The passive oxide film which was formed had a chromium oxide layer to a depth of 1–2 nm from the surface which was identical to that of sample 3 of Embodiment 4; however, when the corrosion resistance test of Embodiment 3 was conducted, slight surface roughness was observed. However, as described above, in consideration of the conditions of the corrosion resistance test, the passive oxide film of Embodiment 7 would be able to sufficiently stand up to use under normal conditions.

(Embodiment 8)

The interior of a SUS316L stainless steel pipe was subjected to composite electrolytic polishing, then a layer altered by working was removed from the surface thereof by electrolytic polishing, baking was conducted in a manner identical to that of Embodiment 1, heat treatment was conducted at a temperature of 500° C. and for a period of 1 hour in an atmosphere of a gas in which hydrogen and oxygen were added to a base argon gas so that the hydrogen concentration reached 10% and oxygen was present at a level of 100 ppb, and a passive oxide film was thus obtained.

Next, the stainless steel pipe on which the above passive oxide film was formed was subjected to welding by means of tungsten inert gas welding, the welded portion was heated to a temperature of 500° C., a gas composed of an argon base gas to which hydrogen and oxygen were added so that the hydrogen concentration was 10% and oxygen was present at a level of 1 ppm, was supplied to the interior of the pipe for a period of 1 hour, and the thermal oxidation treatment of the welded portion was thus conducted.

Figure 10A:
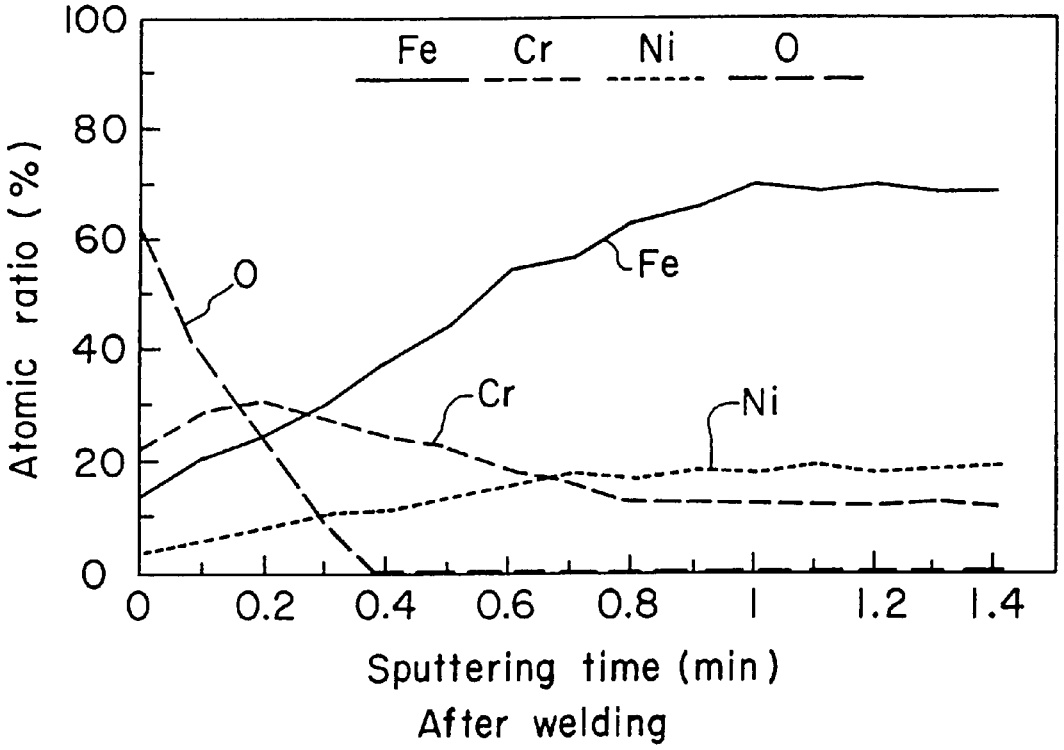
FIG. 10 shows an XPS analysis of the passive oxide films formed after welding and formed at the welded portion.
Figure 10B:
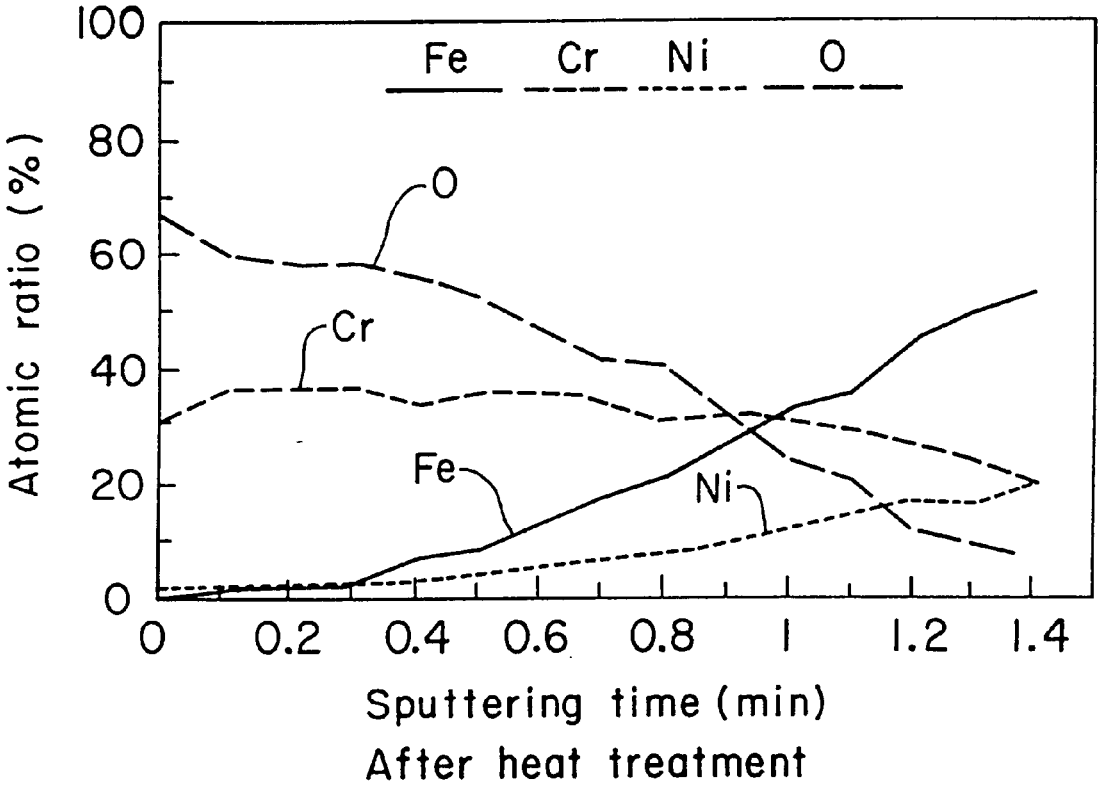

After this, the pipe was severed and an XPS analysis of the welded portion was conducted. The results thereof are shown in FIG. 10. A passive film having an extremely high chromium oxide concentration was formed at the surface of the welded portion as well, although the reason for this is presently unclear.

(Embodiment 9)

In the Embodiment 9, stainless steels were employed having grain numbers of, respectively, 5, 6, 7, and 8. The various stainless steels were processed under conditions identical to those of Embodiment 2, and passive films were formed thereon.

When XPS analyses of the passive films were conducted, it was discovered that the stainless steel having a grain number of 6 had a Cr/Fe ratio which was higher than that of Embodiment 2, the stainless steel having a grain number of 7 had a Cr/Fe ratio which was higher than that of the stainless steel having a grain number of 6, and furthermore, and the stainless steel having a grain number of 8 had a ratio which was higher than that of the stainless steel having a grain number of 7. Furthermore, the thickness of the respective passive oxide films was 5 nm or greater.

(Embodiment 10)

In the Embodiment 10, a stainless steel having a grain number of 5 was employed. Cold working was conducted prior to electrolytic polishing, and a warp of 0.3% was applied. After this, the formation of passive films was conducted under conditions identical to those of Embodiment 2.

When an XPS analysis of the passive film was conducted, it was discovered that a stainless steel was obtained which had passive film characteristics, such as Cr/Fe ratio and thickness, which were identical to that of the stainless steel having a grain number of 8 which was discussed in Embodiment 9.

Industrial Applicability

By means of the present invention, it is possible to easily and rapidly form a passive oxide film having chromium oxide as a chief component thereof by means of a single process, and it is thus possible to greatly shorten processing time.

What is claimed is:

1. A stainless steel possessing a passive oxide film, wherein said stainless steel has a crystal grain number of 6 or more, and said passive oxide film has a thickness of 5 nm or more and an atomic ratio value of Cr/Fe of 1 or more at an outermost layer thereof.

2. A stainless steel possessing a passive oxide film in accordance with claim 1, characterized in that said crystal grain number is 8 or greater.

3. A stainless steel possessing a passive oxide film, wherein said stainless steel possesses a warp of 0.2% or more, and said passive oxide film has a thickness of 5 nm or greater and an atomic ratio value of Cr/Fe of 1 or greater at an outermost layer thereof.

4. A method of forming a passive oxide film having chromium oxide as a chief component thereof, characterized in that stainless steel is subjected to electrolytic polishing, baking is next conducted in an inert gas atmosphere, and moisture is thereby removed from a surface of said stainless steel, heat treatment is next conducted at a temperature within a range of 300° C.–600° C. in a gaseous atmosphere comprising hydrogen or a mixed gas containing hydrogen an inert gas and containing less than 4 ppm of oxygen or less than 500 ppb of moisture.

5. A method of forming a passive oxide film in accordance with claim 4, characterized in that stainless steel having a crystal grain size of 6 or more is used.

6. A method of forming a passive oxide film having chromium oxide as a chief component thereof, characterized in that a stainless steel is subjected to composite electrolytic polishing, baking is next conducted in an inert gas so as to remove moisture from a surface of said stainless steel, and heat treatment is next conducted at a temperature within a range of 300° C.–600° C. in a gaseous atmosphere of hydrogen gas or a mixed gas containing hydrogen and an inert gas and containing less than 4 ppm of oxygen or containing less than 500 ppb of moisture.

7. A method of forming a passive oxide film in accordance with claim 6, characterized in that a stainless steel containing several ppm or below of oxygen is employed.

8. A method of forming a passive oxide film having chromium oxide as a chief component thereof, characterized in that stainless steel is subjected to fluidized abrasive polishing, baking is next conducted in an inert gas atmosphere so as to remove moisture from a surface of said stainless steel, and heat treatment is next conducted at a temperature within a range of 300° C.–600° C. in a gaseous atmosphere containing hydrogen gas or a mixed gas containing hydrogen and an inert gas and containing less than 4 ppm of oxygen or less than 500 ppb of moisture.

9. A method of forming a passive oxide film in accordance with claim 8, wherein a stainless steel containing several ppm or below of oxygen is employed.

10. A method of forming a passive oxide film in accordance with claim 5, characterized in that a stainless steel containing several ppm or below of oxygen is used.

* * * * *